US007611120B2

(12) United States Patent
Wood

(10) Patent No.: US 7,611,120 B2
(45) Date of Patent: Nov. 3, 2009

(54) METHOD AND APPARATUS

(75) Inventor: Carl Wood, Aberdeenshire (GB)

(73) Assignee: Elmar Services Limited, Aberdeen (GB)

( * ) Notice: Subject to any disclaimer, the term of this patent is extended or adjusted under 35 U.S.C. 154(b) by 142 days.

(21) Appl. No.: 11/809,678

(22) Filed: Jun. 1, 2007

(65) Prior Publication Data

US 2007/0278435 A1 Dec. 6, 2007

(30) Foreign Application Priority Data

Jun. 3, 2006 (GB) ..... 0610987.0

(51) Int. Cl.
*E21B 33/06* (2006.01)

(52) U.S. Cl. ..... 251/1.3; 166/86.1

(58) Field of Classification Search ..... 251/1.1, 251/1.3; 166/75.11, 86.1, 88.1, 86.2, 86.3
See application file for complete search history.

(56) References Cited

U.S. PATENT DOCUMENTS

| | | | | |
|---|---|---|---|---|
| 3,845,994 | A | 11/1974 | Trey | |
| 4,050,700 | A | 9/1977 | Lifferth | |
| 4,163,477 | A * | 8/1979 | Johnson et al. | 166/363 |
| 4,227,543 | A * | 10/1980 | Williams, Jr. | 137/246.22 |
| 4,508,313 | A * | 4/1985 | Jones | 251/1.3 |
| 4,583,569 | A | 4/1986 | Ahlstone | |
| 4,923,005 | A * | 5/1990 | Laky et al. | 166/55 |
| 4,938,290 | A | 7/1990 | Leggett et al. | |
| 6,520,302 | B1 * | 2/2003 | Ross | 188/268 |
| 6,676,103 | B2 | 1/2004 | Wood | |
| 6,845,958 | B2 | 1/2005 | Wood et al. | |
| 7,138,202 | B2 * | 11/2006 | Frank et al. | 429/35 |
| 2002/0070016 | A1 * | 6/2002 | Wood | 166/241.5 |
| 2002/0139535 | A1 | 10/2002 | Nice et al. | |
| 2003/0075699 | A1 * | 4/2003 | Wood et al. | 251/1.3 |
| 2005/0087983 | A1 * | 4/2005 | Verger et al. | 285/333 |
| 2005/0133265 | A1 | 6/2005 | Denton et al. | |
| 2005/0184132 | A1 * | 8/2005 | Shabtay | 228/183 |
| 2007/0044976 | A1 * | 3/2007 | Isaacks et al. | 166/387 |
| 2007/0119595 | A1 * | 5/2007 | Carlsen et al. | 166/368 |

FOREIGN PATENT DOCUMENTS

| | | |
|---|---|---|
| EP | 1 186 743 | 3/2002 |
| EP | 1 298 279 | 4/2003 |
| GB | 2 233 365 | 1/1991 |
| WO | WO 95/19410 | 7/1995 |

* cited by examiner

*Primary Examiner*—John K Fristoe, Jr.
*Assistant Examiner*—Marina Tietjen
(74) *Attorney, Agent, or Firm*—Drinker Biddle & Reath LLP

(57) ABSTRACT

An apparatus and a method of substantially sealing a throughbore of a tubular with a line running therethrough. The method comprises the steps of: (a) substantially enclosing the line and sealing a portion of the throughbore around the line using an enclosing means; (b) injecting a fluid that contains solid particles in the region of the line; and (c) substantially sealing a remaining portion of the throughbore using the solid particles such that the sealed throughbore is capable of withstanding a pressure differential. The method can include settling out the solid particles from the fluid in response to a drop in pressure of the fluid during step (b). The method can include injecting a first fluid in the region of the line prior to step (b). The first fluid can be a heavy hydrocarbon such as a grease and the fluid containing solid particles can be a drilling fluid.

17 Claims, 4 Drawing Sheets

METHOD AND APPARATUS

FIELD OF THE INVENTION

The present invention provides a method and apparatus for substantially sealing a throughbore of a tubular wherein the tubular has a line running therethrough, such that the sealed throughbore can withstand a pressure differential, preferably without any leakage of fluid. The invention also provides a method of substantially filling voids in a line. In particular, the method and apparatus is suitable for use in an oil and gas well in conjunction with a blow-out preventor or wireline valve to effectively seal off a wellbore by filling voids in a wireline in the throughbore.

DESCRIPTION OF RELATED ART

In the oil and gas industry, a "blow-out" is a term used to describe an uncontrolled sudden escape of fluids such as gas, water or oil from a wellbore. A blow-out preventor or wireline valve (hereinafter BOP) is a device used to control formation pressures in a well by sealing the wellbore. BOPs can be provided with a centrally disposed aperture extending parallel to the throughbore of the wellbore to allow tubing or wireline running through the wellbore to remain in position when the wellbore is sealed. Thus, BOPs also allow remedial work to be performed on the tubing or wireline by sealing a wellbore under pressure.

In order to seal the wellbore having a wireline running therethrough, the BOP typically closes a pair of rams to seal around the wireline. However, the BOPs can be required to contain a large pressure differential that may be around 5000-15000 psi (34.5-103.4 MPa) or greater. The wireline usually comprises helically wound strands with voids therebetween. Due to the high pressures that the BOP can be expected to contain, it is desirable to ensure that voids in the wireline do not present potential leak paths for high pressure fluids, such as the produced liquids and gases.

BRIEF SUMMARY OF THE INVENTION

According to a first aspect of the invention, there is provided a method of substantially sealing a throughbore of a tubular, the tubular having a line running therethrough, such that the sealed throughbore can withstand a pressure differential, the method comprising the steps of:

(a) substantially enclosing the line and sealing a portion of the throughbore around the line using an enclosing means;

(b) injecting a fluid in the region of the line, wherein the fluid contains solid particles; and (c) substantially sealing a remaining portion of the throughbore using the solid particles such that the sealed throughbore is capable of withstanding a pressure differential.

The method can also include injecting a first fluid in the region of the line and substantially sealing a remaining portion of the throughbore using the first fluid and the solid particles. The method can include injecting the first fluid in the region of the line prior to step (b).

The method can include injecting a greater proportion of the first fluid than the fluid containing solid particles in the region of the line.

The method can include injecting the first fluid and the fluid containing solid particles in series. The method can include injecting the first fluid in the region of the line, followed by injecting the fluid containing solid particles in the region of the line. The method can include injecting between two to five times by volume of the first fluid relative to the second fluid.

The method can include filling voids associated with the line using the first fluid and the solid particles. Preferably the throughbore is substantially sealed such that no leak path exists. The pressure differential that the sealed throughbore may be required to withstand can be up to 15000 psi (103.4 MPa) or greater. The pressure differential may be in the range 2000-15000 psi (13.8-103.4 MPa). The pressure differential may be in the range 3000-10000 psi (20.7-68.9 MPa). The pressure differential that the sealed throughbore is arranged to withstand can be in the range 3000-6000 psi (20.7-41.4 MPa).

The method can include settling out solid particles to substantially plug one or more voids in the line. The method can include settling out solid particles from the fluid in response to a drop in pressure of the fluid.

The method can include substantially enclosing the line and sealing a portion of the throughbore around the line by moving a retractable enclosing means into the throughbore. Preferably, the retractable enclosing means are movable into a closed configuration in which the line is centrally disposed and fluids are substantially restricted from flowing through the throughbore. The method can include enclosing the line by moving the enclosing means in a direction perpendicular to an axis of the tubular. The enclosing means can guide the line to and retain the line in the closed configuration. The method can include substantially sealing around an outer profile of the line using a resilient portion provided on the enclosing means.

The method can include providing a pair of axially spaced enclosing means and substantially enclosing the line at two axially spaced locations thereby sealing a portion of the throughbore around the line arranged parallel to one another. The method can include injecting the fluid(s) between the two axially spaced enclosing means. The method can include providing at least one port in selective fluid communication with the throughbore of the tubular, wherein the or each port provides an opening through which the fluid(s) can be injected and wherein the port is located between the axially spaced enclosing means. The method can include injecting the first fluid and the fluid containing solid particles in the region of the line through separate ports and coupling each port to an injection apparatus.

The method can include injecting the fluid(s) at a higher pressure relative to the ambient pressure of the voids such that the fluid(s) are forced into the voids.

The method can include opening one or more apertures between outer elements of the line to allow the fluid(s) access to one or more voids within the line. This can be achieved by forcing the line into an alternative configuration in which the voids are more accessible to the fluids. The method can include twisting the line to open one or more apertures between the outer elements, prior to enclosing the line. The method can include bending the line to open one or more apertures between the outer elements. The method can include shaping a contact surface of the enclosing means to retain the line in a bent or twisted configuration when the enclosing means are in the closed configuration. The method can include inserting one or more protrusions between the outer elements of the line and thereby opening one or more apertures in the outer elements.

According to a second aspect of the invention there is provided an apparatus for substantially sealing a throughbore of a tubular, the tubular having a line running therethrough, such that the sealed throughbore can withstand a pressure differential, the apparatus comprising:

(a) an enclosing means to enclose the line and seal a portion of the throughbore around the line in use;

(b) a fluid, wherein the fluid contains solid particles; and (c) at least one injector, wherein the or each injector is capable of injecting the fluid containing solid particles in the region of the line such that the remaining portion of the throughbore is capable of being sealed using the solid particles.

The apparatus can also comprise a first fluid, wherein the at least one injector is capable of injecting the first fluid in the region of the line such that the remaining portion of the throughbore is capable of being sealed using the first fluid and the solid particles.

The line can comprise one or more voids. The line can comprise at least one layer of helically wound elements. The line can comprise an outer layer of helically wound elements and an inner layer of helically wound elements. The elements of the outer layer and the elements of the inner layer can be helically wound in opposing directions. An inner protected portion of the line can comprise one or more cables selected from the group consisting of: hydraulic supply lines; power supply lines; and communications cables. The line may be a wireline.

The first fluid can have a higher viscosity than the fluid containing solid particles. The first fluid can comprise a heavy hydrocarbon, such as grease or glycol.

The solid particles can be in suspension with the fluid. The solids particles in the fluid can be arranged to settle out of the fluid. The solid particles can be arranged to settle out of the fluid in response to a drop in pressure of the fluid. The fluid can comprise solid particles of barite.

The solid particles can have a median grain size between 10 and 250 microns. Preferably, the solid particles can have a median grain size between 25 and 150 microns. The larger median grain size of between 200 to 250 microns is typically suited to use with larger diameter lines.

The fluid(s) can be injected at a pressure higher than the ambient pressure in the region of the voids such that the fluid(s) are forced into the voids.

The enclosing means can be selectively movable into the throughbore to substantially enclose the line and seal a portion of throughbore surrounding the line. The enclosing means can be movable perpendicular to the axis of the tubular to a closed configuration in which the portion of the throughbore surrounding the line is substantially sealed.

A pair of enclosing means can be provided, spaced axially relative to the throughbore. The enclosing means can be a blow-out preventor.

The enclosing means can be provided with a resilient portion that is arranged to substantially seal around an outer profile of the line. The resilient portion can comprise an elastomeric material.

The enclosing means can have a contact surface with a recess therein for engaging the line. The recess in the contact surface of the enclosing means can be shaped so as to at least partially bend the line, or otherwise divert the line from a linear configuration, in order to disrupt the voids and make them more accessible to the fluids. After the line has been treated with the fluids, the bent configuration can optionally be relaxed so that the line assumes its normal configuration once more. The or each enclosing means can be provided in at least two parts and the recess in the contact surface of each part can be profiled to cause the line placed therein to at least partially bend. The contact surface of each part of the enclosing means can be provided with a corresponding substantially S-shaped recess for accommodating the line.

The enclosing means can be provided with one or more protrusions for protruding between one or more elements of an outer layer of the tubular to thereby open an aperture between adjacent elements of the outer armour. The recess in the contact surface of the enclosing means can be provided with one or more protrusions therein for opening adjacent elements of the outer armour.

The apparatus can comprise an opener wherein the opener is arranged to be selectively coupled to the line to grip and twist the outer armour so as to change the pitch of the helix and open apertures and voids between adjacent elements.

The fluid containing solid particles and optionally the first fluid can be injected such that the particles and the fluid(s) fill and thereby seal the one or more voids in the line.

Preferably the method and apparatus are suitable for use in a wellbore.

According to a third aspect of the invention, there is provided a method of substantially filling voids in an apparatus, the method comprising the steps of:

(a) injecting a first fluid in the region of the voids;

(b) injecting a second fluid in the region of the voids, wherein the second fluid contains solid particles; and (c) causing the first fluid and the solid particles in the second fluid to fill the voids.

All relevant features and steps of the first and second aspects of the invention are applicable to the third aspect of the invention. The method according to the third aspect of the invention is particularly suited to sealing voids in downhole apparatus.

BRIEF DESCRIPTION OF SEVERAL VIEWS OF THE DRAWINGS

Embodiments of the present invention will now be described with reference to and as shown in the accompanying drawings, in which.

DETAILED DESCRIPTION OF THE INVENTION

Figure 1:
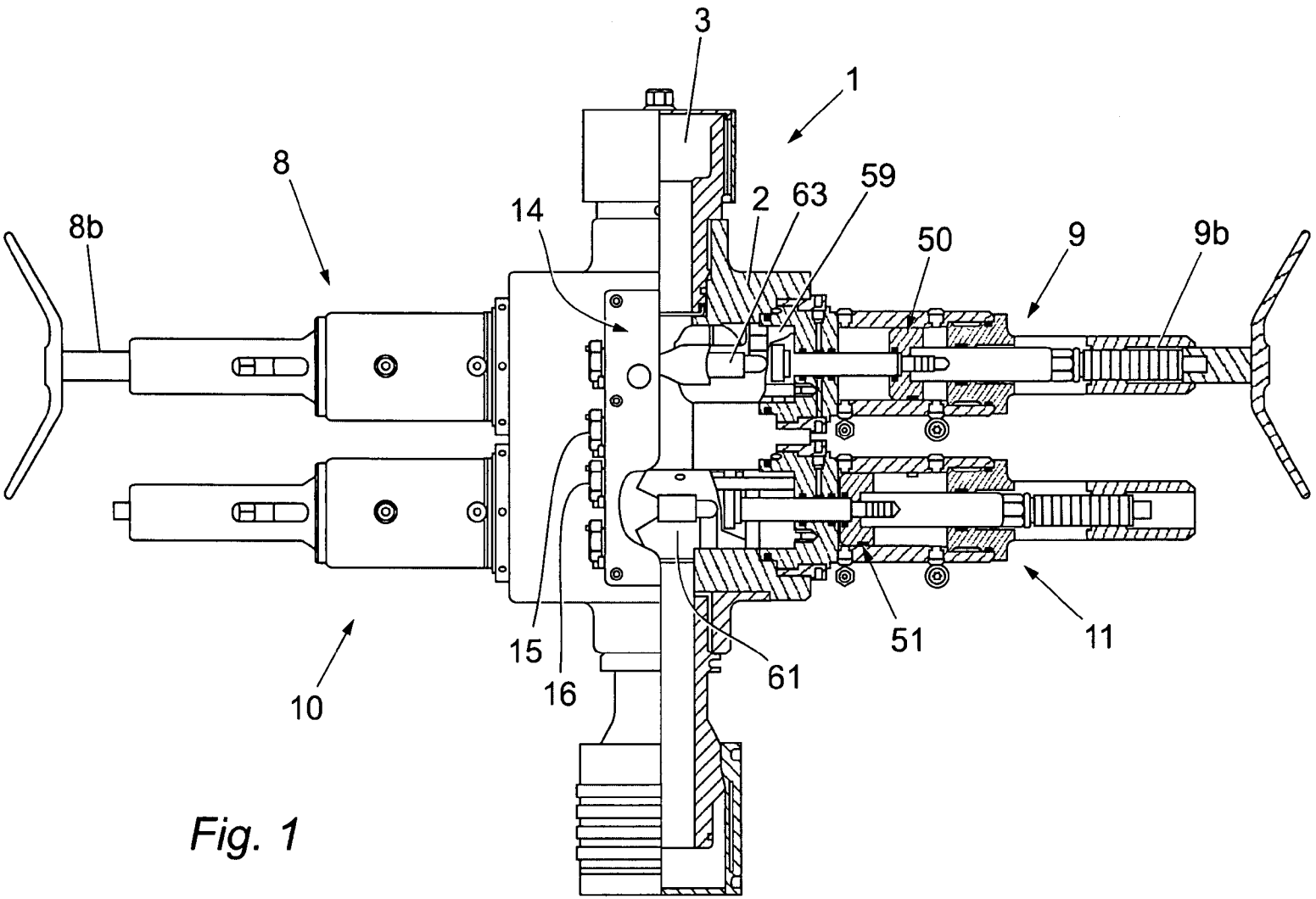
FIG. 1 is a part-side, part-sectional view of a blow-out preventor.

A wireline BOP is shown generally at 1 in FIG. 1. The BOP 1 comprises a body 2 having a throughbore 3, a pair of upper hydraulic actuators 8, 9, and a pair of lower hydraulic actuators 10, 11. Each hydraulic actuator in a pair extends radially outwardly from the body 2 and in opposing relation to the other hydraulic actuator in the pair. Each hydraulic actuator 8-11 houses an actuator assembly 50, 51 and a ram 59, 61. The actuator assembly 50, 51 is operable to retractably move the respective ram 59, 61 provided in the hydraulic actuators 9, 11. The rams 59, 61 are selectively moveable by the associated actuator assembly 50, 51 between an open configuration as shown for the upper pair of hydraulic actuators 8, 9 and a closed configuration as shown for the lower pair of hydraulic actuators 10, 11. In the open configuration at least part of the throughbore 3 is continuous between the opposing rams 58, 59. In the closed configuration, the ram 61 of the hydraulic actuator 11 and the opposing ram associated with the arm 10 engage one another thereby closing the throughbore 3 of the body 2 apart from a centrally disposed aperture. Each hydraulic actuator 8, 9 is provided with a mechanical backup **8*b*, 9*b* that can be screwed up behind the actuator assembly 59 to resist separation of the rams 59** once in the closed configuration.

A manifold 14 is provided on the body 2 with a series of inlets 15, 16 for selectively connecting to pumps (not shown) via conduits (not shown). The inlets 15, 16 are in fluid communication with the throughbore 3 via openings (not shown) located in the body 2 between the pair of upper hydraulic actuators 8, 9 and the pair of lower hydraulic actuators 10, 11.

According to the present embodiment, a first pump suitable for pumping viscous fluid is coupled to a first reservoir (not shown) containing a grease. The first pump is in fluid communication with the inlet 16. A second pump suitable for use with particle fluids can pump fluid from a second reservoir (not shown) containing a drilling fluid or mud (such as Baracarb™, available from Baroid Drilling Fluids or Enviromul™, available from Halliburton) having finely divided barite particles with a grain size of 25 to 150 microns that settle out of suspension with the fluid in response to a drop in pressure of the fluid. The second pump is in fluid communication with the inlet 15.

Figure 2:
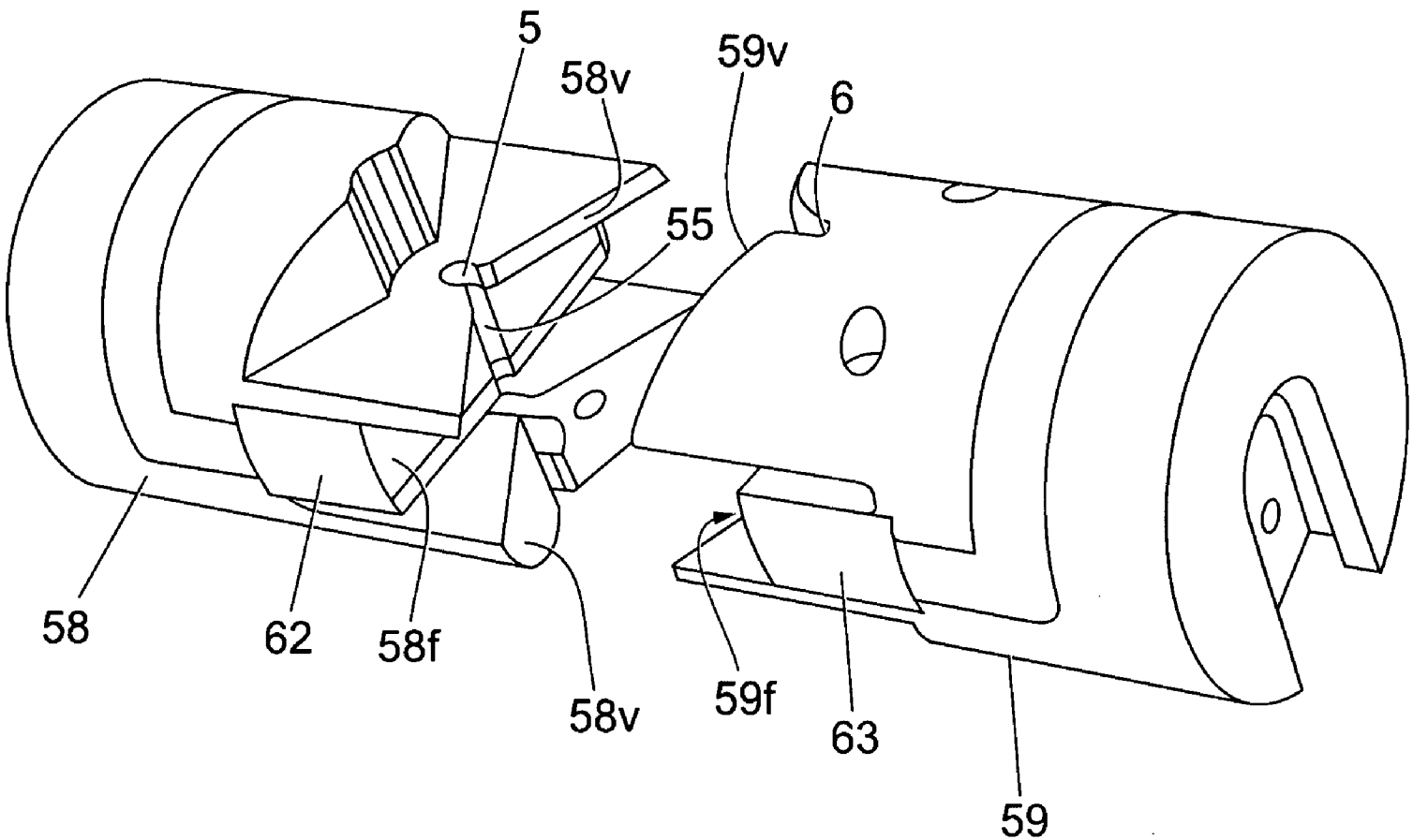
FIG. 2 is a perspective view of a pair of rams of the blow-out preventor of FIG. 1.

The ram 59 associated with the hydraulic actuator 9 and a ram 58 associated with the hydraulic actuator 8 is shown in the open configuration in FIG. 2. The rams 58, 59 are substantially cylindrical in shape with V-shaped guides 58V, 59V at a leading end thereof. The rams 58, 59 also have a contact surface 58F, 59F provided with corresponding apertures 5, 6 and recesses 55. The rams 58, 59 are complementary and in the closed configuration (not shown), the rams 58, 59 interlock with the V-shaped guides 58V, 59V overlaid to seal the throughbore 3. In the closed configuration, the apertures 5, 6 and recesses align in such a way that a continuous passage is formed for accommodating a wireline. The passage is thus provided in the contact surface 58F, 59F of the rams 58, 59 in order to allow a wireline extending through the bore 3 to remain in position.

Figure 3:
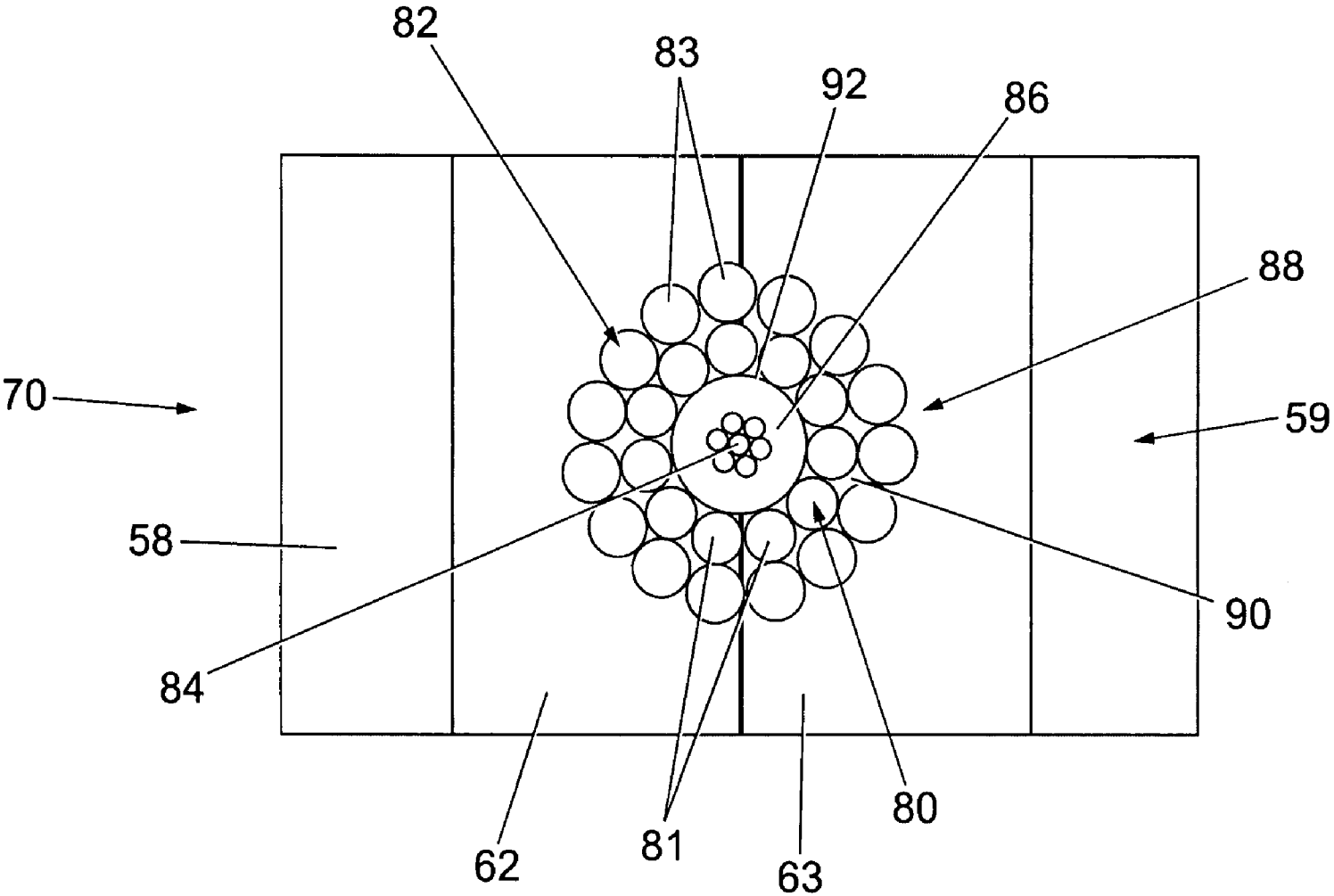
FIG. 3 is a sectional view of the wireline and part of the rams of FIG. 2.

A sectional plan view of the rams 58, 59 in a closed configuration is shown in FIG. 3. Each ram 58, 59 has an elastomeric collar 62, 63. The elastomeric collars 62, 63 conform with the outer profile of a wireline shown generally at 88 and therefore form a seal around the outer profile of the wireline 88 when brought into contact therewith.

The wireline 88 is representative of a typical braided wire, but the skilled person will appreciate that there are other configurations of braided wire having differing strand helix arrangements and varying numbers of armour layers.

The wireline 88 comprises an outer armour 82 consisting of a series of helically wound strands 83 and an inner armour 80 consisting of a series of strands 81 helically wound in an opposing direction to the strands 83 of the outer armour 82. The wireline 88 has a core 86 containing one or more cables 84. Since the strands 81, 83 of the inner armour 80 and outer armour 82 respectively are helically wound in opposing directions there is no nesting of the strands 81 in ridges between the strands 83 of the outer armour 82. As a result, a series of outer voids 90 exist between the inner armour 80 and the outer armour 82. A number of inner voids 92 also occur between the strands 81 of the inner armour 80 and the core 86 of the wireline 88.

Before use, the wireline BOP 1 is typically positioned at a wellhead (not shown) with the body 2 arranged such that the throughbore 3 is substantially vertical and co-axial with a throughbore of the wellhead. During normal operation of the wellbore, production fluids are recovered from the well (not shown) in a controlled manner and both pairs of hydraulic actuators 8-11 are in the open configuration.

Should the throughbore 3 require to be closed, for example, to resist a blow-out from the well or to conduct remedial work on a portion of wireline 88 downstream of the BOP 1, the rams 58, 59, associated with the hydraulic actuators 8,9 are hydraulically activated by the actuator assembly 50 to move into the closed configuration. As the opposing rams 58, 59 are moved towards one another, the V-shaped guides 58V, 59V contact the wireline 88 and guide it towards the centrally disposed passage created by the apertures 5, 6 and recesses 55. In this way the throughbore 3 is substantially sealed and the wireline 88 is captured within the passage. The elastomeric collars 62, 63 seal around the outer profile of the wireline 88. The mechanical backup 8*b*, 9*b* can be screwed into position behind the actuator assembly 50 to retain the rams 58, 59 in their closed configuration in the event of a failure of the hydraulic system. Similarly, the rams housed within the lower pair of hydraulic actuators 10, 11 are moved into the closed configuration.

The inner and outer voids 92, 90 remain unsealed within the wireline in the throughbore 3 and therefore pose a potential leak path. Accordingly, viscous grease is first pumped through the inlet 16 of the manifold 14 to the opening between the upper and lower hydraulic actuators 8-11. The grease is injected through the openings at a higher pressure than the well pressure and substantially fills the inner and outer voids 92, 90. The pumping continues until a steady leak of the grease is registered and the well pressure is controlled at an acceptable level that enabling the seal to withstand a certain predetermined pressure across the throughbore 3. The first pump is stroked until the sealed area between the hydraulic actuators 8-11 is packed with grease and the voids 90, 92 are filled with sufficient grease. At this stage, a drilling fluid containing solid barite particles is pumped through the opening located between the pairs of hydraulic actuators via the inlet 15 of the manifold in order to plug the voids 90, 92 in the wireline 88. The second pump forces drilling fluid out of the openings at high pressure. However, the pressure of the fluid drops once pumped into the wireline 88 and the energy loss causes, the finely divided barite particles to settle out of suspension with the fluid and plug the voids 90, 92 thereby blocking the leak path and substantially sealing the voids 90, 92 within the wireline 88.

In order to avoid a situation where the outer voids 90 are bridged prior to plugging the inner voids 92 it may be necessary to open gaps between one or more strands 83 of the outer armour 82 to allow the fluids access to the inner voids 92 and avoid initial bridging of the outer armour 82 prior to sealing the inner voids 92. There are several alternative methods by which this can be achieved.

Figure 4:
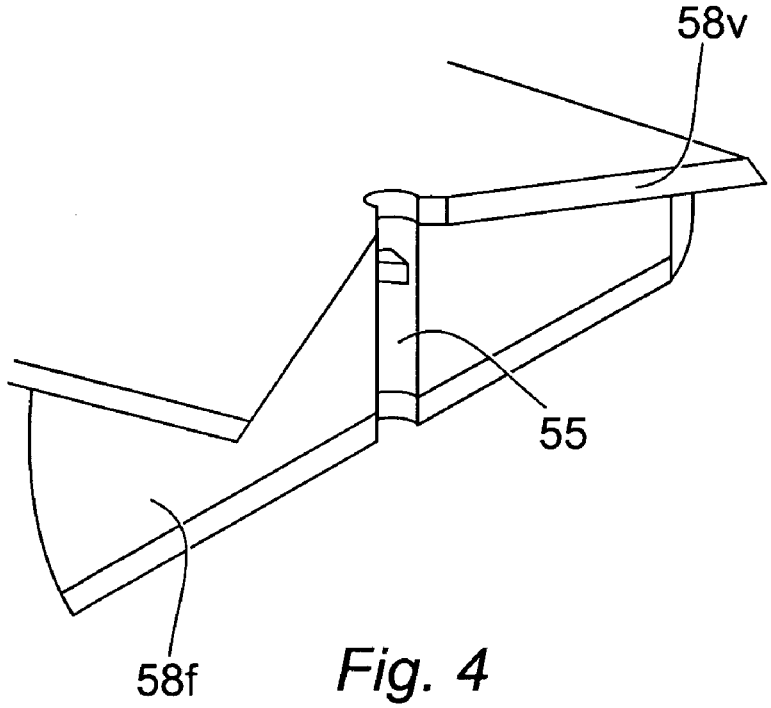
FIG. 4 is a close up view of a first alternative ram to those shown in FIG. 2.

The contact surface 58F, 59F of the rams 58, 59 in the region of the apertures 5, 6 or recesses 55 can be provided with one or more small protrusions shown in FIG. 4. These protrusions can have a pointed end and can be arranged such that the pointed end nests between outer strands 83 to thereby part two or more of the strands 83 and open gaps therebetween.

Figure 5:
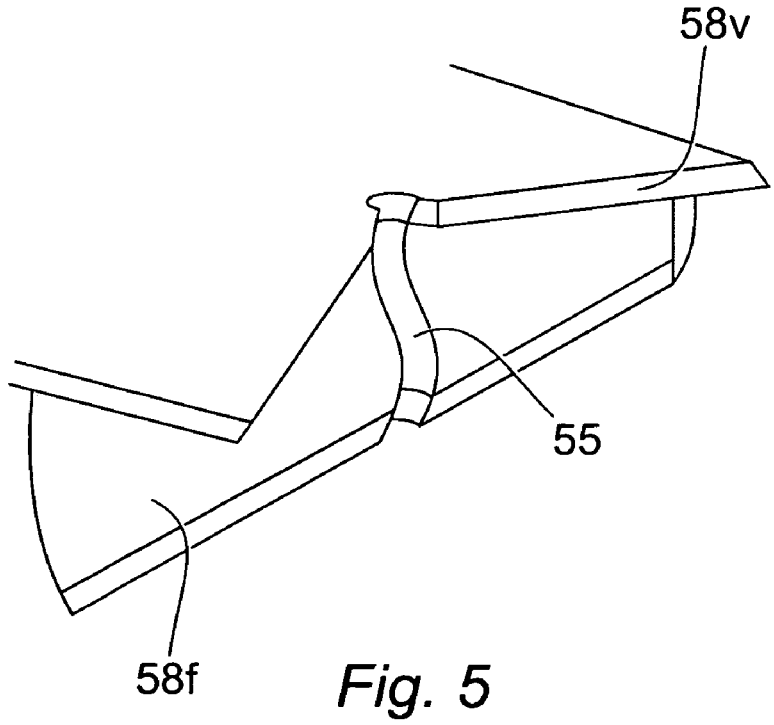
FIG. 5 is a close up view of a second alternative ram to those shown in FIG. 2 and FIG. 4.

In an alternative embodiment, the contact surface 58F, 59F of the rams 58, 59 can be provided with corresponding S-shaped recesses (shown in FIG. 5) such that the wireline 88 conforms to a bent shape when the wireline BOP 1 occupies the closed configuration. A bending of the wireline 88 has the effect of opening the outer strands 83 on outside edges of the S-bend.

Alternatively, prior to or simultaneous with sealing the BOP 1 an opener (not shown) can be provided to grip around the outer armour 82 and twist the strands 83 to thereby alter the pitch of the wireline 88 helix and open gaps between the strands 83.

Using the above described method, the throughbore 3 is sealed by the rams 58, 59 and the voids 90, 92 can be filled and sealed to eliminate potential leak paths and contain high pressures within the wellbore.

Modifications and improvements can be made without departing from the scope of the invention. In particular, the embodiment described above concerns sealing the wellbore using a wireline BOP 1. However, the general method of sealing voids within apparatus according to the present invention can be used in other applications. Although the above described embodiment utilises grease in addition to the drilling fluid for sealing the wireline 88, it will be appreciated that the drilling fluid can be used without the grease for the same purpose of sealing voids in a wireline 88. The fluid containing solid particles that is the drilling fluid or mud according to the described embodiment can be selected according to the specific application and the diameter of the wireline 88. For example, wireline 88 having a greater diameter may be used with drilling muds having a larger median grain size of around 200 to 250 microns.

The invention claimed is:

1. A method of substantially sealing a throughbore of a tubular, the tubular having a line running therethrough, such that the sealed throughbore can withstand a pressure differential, the method comprising the steps of:

(a) substantially enclosing the line and sealing a portion of the throughbore around the line using an enclosing mechanism to define an enclosed portion of the throughbore;

(b) providing a fluid suspension containing a suspension of solid particles, wherein the solid particles are adapted to settle out of suspension in response to a pressure drop in the fluid suspension, and injecting the fluid suspension into the enclosed portion of the throughbore at a higher pressure than the ambient pressure in the enclosed portion of the throughbore, whereby the pressure of the fluid suspension drops during said injecting step, causing the solid particles to settle out of suspension after injection; and (c) substantially sealing a remaining portion of the throughbore using the solid particles such that the sealed throughbore is capable of withstanding a pressure differential.

2. A method according to claim 1, including injecting a first fluid into the enclosed portion of the throughbore prior to step (b) and substantially sealing any remaining voids in the enclosed portion of the throughbore according to step (c) using the first fluid and the solid particles.

3. A method according to claim 2, including injecting a greater proportion of the first fluid than the fluid containing solid particles in the enclosed portion of the throughbore.

4. A method according to claim 2, including filling voids associated with the line using the first fluid and the solid particles, such that the sealed throughbore is arranged to withstand a pressure differential of up to 15000 psi (103.4 MPa).

5. A method according to claim 2, including filling voids associated with the line using the first fluid and the solid particles, such that the sealed throughbore is arranged to withstand a pressure differential in the range of 3000-6000 psi (20.7-41.4 MPa).

6. A method according to claim 2, including injecting the first fluid and the fluid containing solid particles in the region of the line through separate ports and coupling each port to an injection apparatus.

7. A method according to claim 1, including performing step (a) by moving the enclosing mechanism into a closed configuration in which the line is substantially centrally disposed and fluid(s) are substantially restricted from flowing through the throughbore.

8. A method according to claim 7, including providing a pair of axially spaced enclosing members and performing step (a) at two axially spaced locations, thereby sealing an annular portion of the throughbore around the line and further including injecting the fluid(s) between the two axially spaced enclosing members.

9. A method according to claim 1, including injecting the fluid(s) at a higher pressure relative to the ambient pressure of voids associated with the line such that the fluid(s) are forced into the voids.

10. A method according to claim 1, including opening at least one aperture in an outer part of the line to allow the fluid(s) access to voids associated with the line.

11. A method according to claim 8, including shaping a contact surface of the enclosing members to divert the line from a first configuration into a second configuration, and to retain the line in the second configuration in which voids associated with the line are more accessible to fluids when the enclosing members are in contact with the line than when the line is in the first configuration.

12. Apparatus for substantially sealing a throughbore of a tubular, the tubular having a line running therethrough, such that the sealed throughbore can withstand a pressure differential, the apparatus comprising:

an enclosing mechanism to enclose the line and seal an enclosed portion of the throughbore around the line in use;

a fluid suspension containing a suspension of solid particles, wherein the solid particles are adapted to settle out of suspension in response to a pressure drop in the fluid suspension; and at least one injector, wherein the or each injector is configured to inject the fluid suspension containing solid particles into the enclosed portion of the throughbore at a higher pressure than the ambient pressure in the enclosed portion of the throughbore, whereby the pressure of the fluid suspension drops during injection, causing the solid particles to settle out of suspension after injection such that the remaining portion of the throughbore is capable of being sealed using the solid particles.

13. Apparatus according to claim 12, comprising a first fluid, wherein the at least one injector is capable of injecting the first fluid in the region of the line such that the remaining portion of the throughbore is capable of being sealed using the first fluid and the solid particles.

14. Apparatus according to claim 12, wherein voids are associated with the line and the fluid(s) can be injected at a pressure higher than the ambient pressure of the voids such that the fluid(s) are forced into the voids so that the fluid(s) fill and thereby seal the voids in the line.

15. Apparatus according to claim 12, wherein a pair of enclosing members are provided, spaced axially relative to the throughbore and wherein each enclosing member is provided with a resilient portion that is arranged to substantially seal around an outer profile of the line.

16. Apparatus according to claim 15, wherein the enclosing members have a contact surface for engaging the line, wherein the contact surface is shaped so as to divert the line from a linear configuration into a bent configuration in order to disrupt voids associated with the line and make them more accessible to the fluids in the bent configuration than when the line is in the linear configuration.

17. A method of substantially sealing a throughbore of a tubular by substantially filling voids in the throughbore of the tubular, the tubular having a line running therethrough, the method comprising:

defining an enclosed portion of the throughbore by applying an enclosing mechanism around the line and sealing a portion of the throughbore around the enclosed region of the line;

injecting a first fluid into the enclosed portion of the throughbore thereby causing the first fluid to fill the voids, wherein the first fluid comprises a grease;

injecting a second fluid into the enclosed portion of the throughbore, thereby causing the solid particles in the second fluid to fill the voids, wherein the second fluid comprises a fluid suspension containing solid particles; and causing a pressure drop in the second fluid after being injected into the enclosed region, thereby causing the solid particles in the second fluid to settle out of suspension from the second fluid after the second fluid has filled the voids.

* * * * *